United States Patent [19]

Dickakian

[11] Patent Number: 4,853,337

[45] Date of Patent: Aug. 1, 1989

[54] BLENDING OF HYDROCARBON LIQUIDS

[75] Inventor: Ghazi B. Dickakian, Kingwood, Tex.

[73] Assignee: Exxon Chemicals Patents Inc., Linden, N.J.

[21] Appl. No.: 253,940

[22] Filed: Oct. 5, 1988

Related U.S. Application Data

[63] Continuation-in-part of Ser. No. 48,167, May 11, 1987, abandoned.

[51] Int. Cl.[4] ..... G01N 30/90; Z10G 9/12

[52] U.S. Cl. ..... 436/55; 208/14; 208/18; 208/19; 208/DIG. 1; 208/48 R; 436/60; 436/139; 585/1; 585/13

[58] Field of Search ..... 208/14, 18, 19, 48 R, 208/DIG. 1; 436/161, 155, 139, 143, 55; 585/1, 13

[56] References Cited

U.S. PATENT DOCUMENTS

| | | | |
|---|---|---|---|
| 1,547,141 | 7/1925 | Wilson | 208/18 |
| 2,070,383 | 2/1937 | Tuttle | 208/18 |
| 2,121,517 | 6/1938 | Brandt | 208/39 |
| 2,410,381 | 10/1946 | Jenkins | 252/59 |
| 2,472,669 | 6/1949 | Mathy | 208/48 R |
| 2,687,989 | 8/1954 | Goodwin | 196/74 |
| 2,762,757 | 9/1956 | Bedell | 196/74 |
| 2,903,412 | 9/1959 | Longland, Jr. | 208/41 |
| 2,996,455 | 8/1961 | Brown et al. | 252/59 |
| 3,184,396 | 5/1965 | Armslrond | 196/132 |
| 3,332,856 | 7/1967 | Hart | 585/1 |
| 3,507,786 | 4/1970 | Walker et al. | 208/308 |
| 3,666,932 | 5/1972 | White | 208/DIG. 1 |
| 3,672,840 | 6/1972 | Fenske et al. | 208/DIG. 1 |
| 3,725,245 | 4/1973 | Woodle | 208/86 |
| 3,791,959 | 2/1974 | Mills et al. | 208/19 |
| 3,826,904 | 7/1974 | Leonard et al. | 208/DIG. 1 |
| 3,868,315 | 2/1975 | Forster etal. | 208/6 |
| 3,907,388 | 9/1975 | Stanton et al. | 208/DIG. 1 |
| 3,929,626 | 12/1975 | Button et al. | 208/309 |
| 3,970,543 | 7/1976 | McIntosh | 208/86 |
| 3,989,616 | 11/1976 | Pagen et al. | 208/18 |
| 4,048,056 | 9/1977 | Romovacek | 208/41 |
| 4,213,845 | 7/1980 | Masada | 208/19 |
| 4,341,634 | 7/1982 | Matsushita et al. | 210/656 |
| 4,671,103 | 6/1987 | Dickakian | 210/656 |

OTHER PUBLICATIONS

Chemistry of Asphaltenes, Bunger Am. Chem. Soc.: Advances in Chemistry Series 195, Sep. 1983, pp. 53 and 76–80.

*Primary Examiner*—H. M. S. Sneed
*Assistant Examiner*—Helane Myers
*Attorney, Agent, or Firm*—R. L. Graham

[57] ABSTRACT

Crude oil (one of which is a high fouling crude oil) are blended to maintain the incompatible asphaltene thereof below a predetermined level thereby reducing the fouling tendency of the high fouling crude oil. Paraffinic liquids, LPG's, and condensates may also be blended with crude oil, while monitoring and controlling incompatible asphaltenes thereof.

17 Claims, 2 Drawing Sheets

BLENDING OF HYDROCARBON LIQUIDS

RELATED U.S. APPLICATIONS

This is a continuation-in-part of application Ser. No. 048,167, filed May 11, 1987, now abandoned.

BACKGROUND OF THE INVENTION

This invention relates to crude oil fouling. In one aspect the invention relates blending hydrocarbon streams to minimize fouling.

Fouling of process equipment is a continually costly problem in the petroleum and chemical industries. The fouling of heat exchangers by crude oils is the result of inorganic and organic carbonaceous deposits formation on the metal surface.

Deposition is caused by a combination of chemical reactions and physical changes that occur when crude oil is heated. These deposits increase pressure drop, block process flow, and cause the decrease of heat recovery from the process stream. Characterization of the deposits indicates the presence of inorganic material, infusable coke and asphaltenes.

All crude oils are composed of two major components, a low molecular weight oil fraction, and a high molecular weight fraction insoluble in paraffinic solvents. This fraction is called $C_7$-asphaltenes. As used herein the term "asphaltenes" refers to these paraffinic insoluble asphaltenes.

Fouling in crude oil heat exchangers in a function of crude oil composition, asphaltene presence, inorganic materials, process pressure and the temperature of the metal surface. Although there are a number of mechanisms which contribute to crude oil fouling, tests have shown asphaltene/oil incompatibility is a major contributing factor. Asphaltenes are characterized by a high average molecular weight and very broad molecular weight distribution (up to 5000).

The Thermal Fouling Tester (TFT) is widely used in the petroleum industry to measure crude oil fouling. The TFT test comprises circulating the crude oil through a miniaturized heat exchanger housing equipped with a carbon/steel heater tube while monitoring outlet temperatures of the crude oil. Fouling is determined by the decrease in fluid outlet temperature which is caused by deposit formation on the heater surface.

TFT unit does not simulate exactly refinery heat exchanger fouling. This test accelerates fouling by providing an increased inlet oil temperature in order to perform a test in the laboratory in a reasonable time (3–24 hours). However, the TFT is a valuable tool for research, investigating fouling mechanisms and for developing antifoulant.

Although antifoulant chemical may be employed to reduce or inhibit the fouling tendency, this type of treatment is expensive. Efforts have been made to blend low fouling crude with high fouling crude but, as will be discussed below, such efforts may in fact exacerbate the fouling tendency of the crude oil.

SUMMARY OF THE INVENTION

Figure 2:
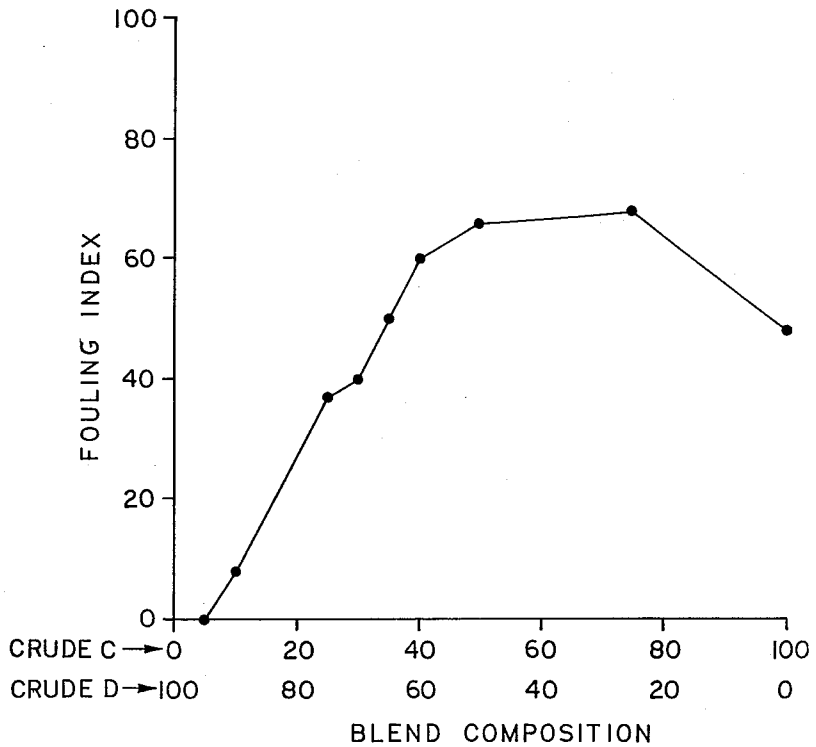
FIGS. 1 and 2 are plots showing the fouling tendency of two crude oils and various blends thereof.

The present invention, in part, relies on the discovery that the fouling tendency of a crude oil (i.e. liquid hydrocarbon) is based upon incompatible asphaltenes in the oil fraction of the liquid hydrocarbon. This may be expressed as the ratio of the aromatics and the asphaltenes content of the crude oil or the hydrocarbon liquid. As disclosed in the inventor's co-pending application U.S. Ser. No. 849,600, filed Apr. 8, 1986 now U.S. Pat. No. 4,762,797, the compatibility of asphaltenes in a hydrocarbon liquid depends upon the aromatic (total aromatics) content of the liquid. Thus, a crude oil containing relatively high amounts of asphaltene may not have a high fouling tendency if the crude oil also contains relatively high amount of aromatics. However, when the low molecular weight fraction of the crude oil is a saturate such as a paraffinic crude, the incompatibility of the low molecular weight oil and the asphaltene results in high fouling tendency.

In one aspect, the present invention contemplates a method of blending crude oils which comprises:

a. selecting a crude oil with a high aromatic/asphaltene ratio (i.e. asphaltenes are compatible in the crude oil);
b. selecting a crude oil with a low aromaticasphaltene ratio (i.e. crude oil contains incompatible asphaltenes); and
c. blending the crude oils in such a ratio to maintain substantial compatibility of the asphaltenes in the crude oil blend.

Step c may require continual monitoring of the blend to insure that the combined aromatic to asphaltene ratio is maintained above a predetermined level.

In another aspect of the invention, a blending operation is carried out by:

a. selecting a substantially paraffinic oil;
b. selecting a crude oil containing asphaltenes; and
c. blending the paraffinic oil and the crude oil at a ratio to maintain the combined aromatic to asphaltene ratio above a certain predetermined level.

The predetermined level of aromatic/asphaltene ratio to maintain compatibility will depend on several factors, including the fouling tendency of the crude oils. In general however, the predetermined level in the case of blending two crude oils will be intermediate the fouling tendencies of each crude. In the case of blending paraffinic liquids with crude oil, the aromaticasphaltene ratio will be controlled to prevent undue decreases which could result in fouling problems. Generally, blending to maintain the aromatic/asphaltene ratio above 15 will provide a low to medium fouling blend and 20 and above will provide a low fouling blend.

DESCRIPTION OF THE PREFERRED EMBODIMENTS

The method of the present invention will be described primarily with reference to blending of crude oils and blending of paraffinic liquids with crude oil. However, it will be apparent to those skilled in the art that the blending method can also be utilized in blending of any hydrocarbon liquids, at least one of which contains asphaltenes. The method involves (a) determining, directly or indirectly, the weight ratio of aromatics to asphaltenes in the crude which provides a measure of the incompatible asphaltene in the crude and hence indicates the fouling tendency of the crude; and (b) blending certain crudes to maintain such ratio above a predetermined level, preferably above 15 and most preferably above 19. The predetermined level will depend on the crude oil selected and will vary on a case to case basis. In some instances the predetermined level will be that which provides for low fouling blend. In other instances, the optimum may be that which provides for a medium fouling blend.

The present invention requires the determination of a hydrocarbon oil tendency to foul based upon the incompatibility of the asphaltenes (e.g. aromatic/asphaltene ratio) in the hydrocarbon liquid. This can be determined by several techniques including (a) the methods described in the aforementioned U.S. patent application Ser. No. 849,600, now U.S. Pat. No. 4,762,797, (b) the High Performance Liquid Chromatographic (HPLC) method described in U.S. patent application Ser. No. 720,840, filed Apr. 8, 1985 now U.S. Pat. No. 4,671,103, (c) the chromatographic separation methods described in copending U.S. patent application Ser. Nos. 723,598 and 830,386, filed Apr. 15, 1986 and Feb. 18, 1986, now U.S. Pat. No. 4,751,187 and 4,752,587 respectively, as well as the methods and apparatus described in U.S. patent application Ser. Nos. 910,910 and 024,730, filed Sept. 24, 1986 and Mar. 11, 1987, now U.S. Pat. No. 4,781,892 and 4,781,893 respectively. The disclosures of these six U.S. Patent Applications are expressly incorporated herein by reference. Other methods include the use of carbon to hydrogen atomic and nuclear magnetic resonance (NMR) spectroscopy for determining aromaticity of the hydrocarbon liquid, which compared with asphaltenes provides the ratio indicative of compatibility.

The preferred technique for determining asphaltene incompatibility is by chromatographic separation described in the aforementioned U.S. patent applications. The results can be represented as a fouling index. As described in U.S. patent application Ser. No. 849,600 and 910,910, the fouling index is a scale of 0–100 and indicates the fouling tendency according to the following:

| Fouling Tendency | Aromatic/ Asphaltene Ratio | Fouling Index | TFT (ΔT °F.) |
|---|---|---|---|
| low | 20+ | 0–20 | 0–15 |
| medium | 16–19 | 21–40 | 16–39 |
| high | 0–15 | 41–100 | 40+ |

The fouling index was developed by comparing the results of chromatographic separation methods (for determining asphaltene incompatibility) with results obtained by the well known TFT method.

As indicated above, the blending method of the present method has many applications, two of which are described below.

Blending of High Fouling Crude with Low Fouling Crude

In this embodiment of the invention, the crude oils are blended prior to introduction into the refinery in a controlled ratio such that the fouling tendency of the crude oil blend is maintained below a predetermined level. In practice, the fouling tendency of each crude oil will be determined by one of the methods described above and a characteristic curve based upon different ratios of the crude will be prepared based on the fouling tendency of the various ratios of the blends. The curve will indicate approximately the optimum ratio. This application of the invention is best described with reference to specific examples.

EXAMPLE 1

It was desired to blend a low fouling crude oil with a high fouling crude oil in the proper proportions to produce a low fouling blend. The crude oils had the following compositions and fouling characteristics as determined by the HPLC Method and the TFT Methods described above.

TABLE I

| | Crude A | Crude B |
|---|---|---|
| Total Aromatics (wt %) | 41.0 | 14.0 |
| $C_7$ Asphaltene (wt %) | 0.87 | 1.3 |
| Aromatic/Asphaltene Ratio* | 48.0 | 11.0 |
| TFT-Fouling (ΔT, °F.)** | 11.0 | 56.0 |
| Fouling Tendency | Low | High |

Crude A and Crude B were then blended volumetrically at the ratios indicated in Table II and the blends were analyzed for total aromatics, asphaltenes, and TFT fouling.

TABLE II

| | Crude Blend Composition (Vol %) | | |
|---|---|---|---|
| Crude A | 75 | 50 | 25 |
| Crude B | 25 | 50 | 75 |
| Total Aromatics (wt %) | 30.3 | 26.6 | 19.2 |
| $C_7$ Asphaltene (wt %) | 0.98 | 1.15 | 1.13 |
| Aromatic/Asphaltene Ratio* | 30.9 | 23.1 | 17.0 |
| TFT-Fouling** | 20 | 16 | 30 |
| Fouling Tendency | Low | Low | Medium |

*Determined by HPLC method.
**700° F. heater temperature for 4 hours.

Figure 1:
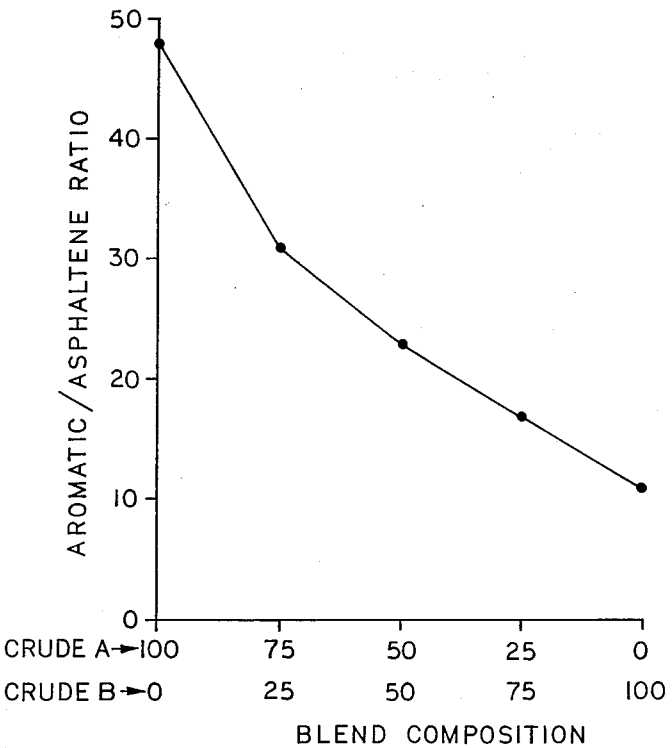

FIG. 1 is a graphical illustration of the Tables I and II data indicating the fouling tendency based on the Aromatic/Asphaltene ratio of crudes A and B and blends thereof. From the curve of FIG. 1 it can be seen that the blend for low fouling in accordance with the fouling index range for low fouling crude can comprise from approx. 60 to 100 Vol. % of Crude A and from 0 to 40 Vol. % of Crude B.

EXAMPLE II

Additional experiments were conducted using a testing apparatus (described in U.S. Application Ser. No. 910,910 and referred to as AFC™ Fouling Analyzer by Exxon Chemical Co.) based on Thin Layer Chromatography Crude oils C and D with low and high fouling characteristics, respectively, were blended in the following volume ratios of crude oil C (0%, 5%, 10%, 25%, 30%, 35%, 40%, 50%, 75%, 100%). The fouling characteristics of the two crude oils and the various blends were determined using Exxon AFC TM Fouling Analyzer. The results are presented graphically in FIG. 2.

As seen in FIG. 2, up to 305 of Crude C in the blend may be used and still produce a blend with low-medium fouling characteristics.

Blending of Crude Oil with Paraffinic Liquid

It frequently is desired to blend paraffinic products which are essentially free of asphaltenes with crude oil for various purposes such as pipeline transportation or storage. When the crude oil is low in asphaltenes, one might expect that the blending might be carried out at any desired ratio since both of the blended hydrocarbons are low in asphaltenes and would expect to be low in fouling tendency. Tests have shown, however, that when blending the paraffinic hydrocarbons such as condensates, liquified LPG's liquid petroleum gas, or liquified natural gas or $C_3$ to $C_4$, $C_5$ to $C_6$ paraffinic hydrocarbons, the fouling tendency of a low to medium fouling crude oil can be increased even to the level of high fouling tendency. It is believed that the reason for this is the addition of the saturated hydrocarbons decreases the ratio of aromaticsasphaltenes which, as described above, accounts for the fouling.

The present invention, in one aspect, provides a method of blending a hydrocarbon liquid such as crude oil which contains asphaltenes with a substantially paraffinic hydrocarbon liquid such as LPG or $C_3$, $C_4$, $C_5$, $C_6$ hydrocarbons, condensates, and similar cuts or blends of these cuts.

As in the examples described above, the mentioned may employ HPLC and TLC analytical techniques and TFT methods. The fouling tendency is determined by these techniques for each of the hydrocarbon liquids to be blended, and at various ratios. A characteristic curve may then be then prepared and the optimum blending ratio selected. The following illustrates the procedure with reference to specific crude oil and a paraffinic hydrocarbon liquid.

In blends of one or more volatile hydrocarbons (e.g. LPG), pressurized TFT methods may be employed. Also, characteristic curve of a nonvolatile paraffinic liquid such as $C_5$ to $C_8$ paraffin (preferably $C_5$ to $C_6$, and most preferably pentane) may be used for the volatile fractions. For example, a characteristic curve based on mixtures of various amounts of pentane and the crude oil in question may be prepared by TLC techniques and used to determine the desired ratio of the volatile hydrocarbon and the crude oil in question. The curve of FIG. 3 described below indicated that the crude F cannot tolerate large quantities of paraffinic liquids. On the other hand, crude E of experiment 4 can tolerate relatively large amounts of paraffinic oils. The curves of FIGS. 3 and 4 can be used to determine desired blends of volatile paraffins (e.g. LPG, $C_3$ and $C_4$) with crudes F and E, respectively. Similar experiments on other crudes using the pentane tolerance test indicates that some crudes can tolerate up to 15–20 volume percent of pentane and (by correlation) other paraffinic liquids such as LPG. Tests based on TLC techniques on an Alaskan crude using pentane/crude blends revealed on set of asphaltene fouling at about 40 to 45 vol% pentane. Asphaltene floculation tests in a pressurized autoclave using 80/20 volume ratio of the same crude and LPG revealed no asphaltene separation. However, similar tests on the same crude revealed high asphaltene separation with 50 or more vol% LPG. Butane or paraffinic liquids containing butane may be used in developing the characteristic curve by TLC methods at lower than room temperatures to prevent evaporation of the butane or butane blend.

EXAMPLE III

Crude oil (F) and n-pentane were blended at various volumetric ratios (0%, 1%, 2%, 5%, 7.5%, 15%, and 20% of pentane).

The fouling characteristics of the crude/pentane blends were determined by Exxon AFC TM Fouling Analyzer.

Figure 3:
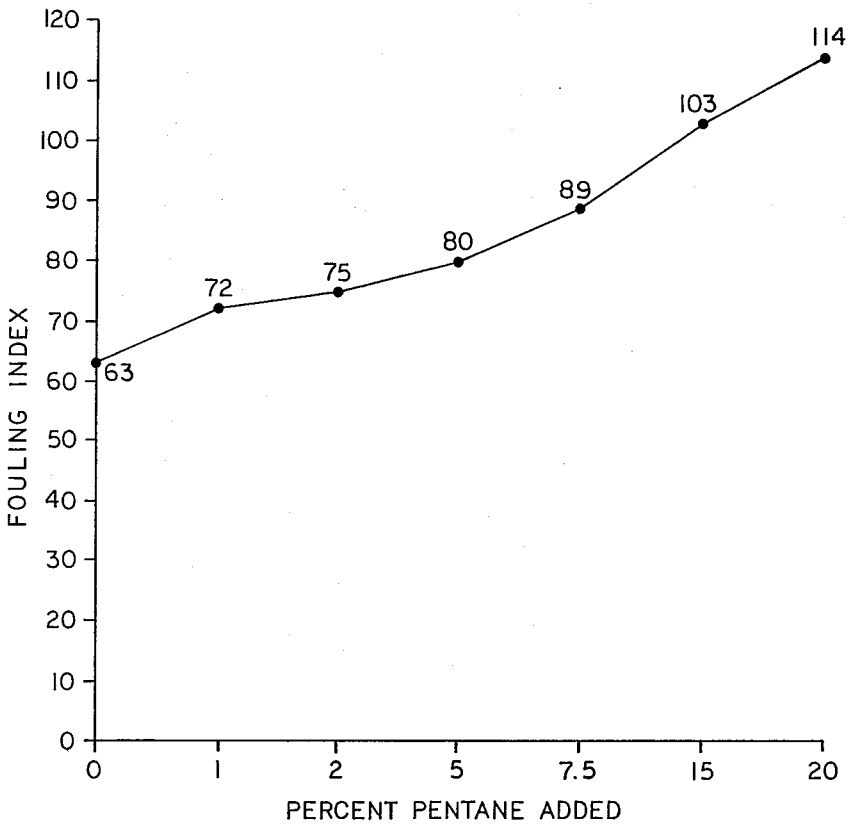
FIG. 3 is a plot showing the fouling characteristics of n-pentane and various n-pentane/crude oil blends.

As can be seen in FIG. 3, the addition of pentane (i.e. paraffinic hydrocarbon) to crude oil increases its fouling characteristics.

EXAMPLE IV

A low fouling crude oil (E) and a low fouling condensate were blended with condensate concentration of 0%, 10%, 20%, 30%, 40%, 50%, 60%, 70%, 80%, 90%, and 100%. The fouling characteristics of the crude oil (E), condensate; and the various blends thereof were determined by Exxon AFC TM Fouling Analyzer referred to above. The fouling results are presented graphically in FIG. 4.

Figure 4:
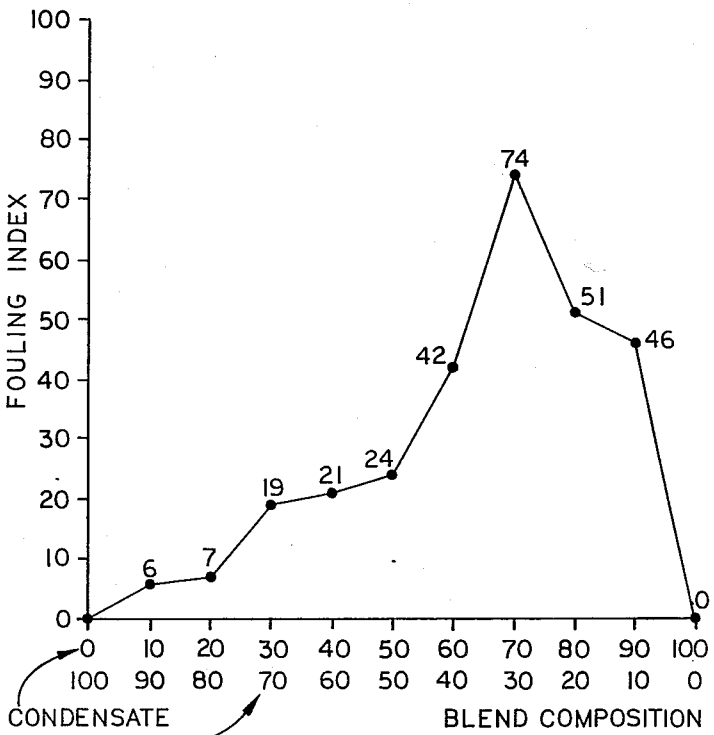
FIG. 4 is a plot showing fouling characteristics of a crude oil and condensate and various crude oil/condensate blend ratios.

From FIG. 4, it can be seen that condensate/crude oil blend ratios up to 1:1 are possible without causing serious fouling problems.

Analytical Techniques

The following techniques may be employed in determining the fouling tendency of crude oils or blends. These techniques are directly or indirectly an indicator of the incompatibility of asphaltenes in the low molecular weight portion of the crude or hydrocarbon liquid.

HPLC Method

The fouling characteristics of crude oils or other hydrocarbon liquids is measured by determining quantitatively the composition of the deasphaltenated liquid by High Performance Liquid Chromatography (HPLC). By the HPLC method, the hydrocarbon liquid is separated into a saturate fraction and aromatic fractions. The saturate fractions includes the alkanes, cycloalkanes, and substituted alkanes. The aromatics include the neutral aromatics and the polar aromatic compounds. These compounds are unsaturated cyclic hydrocarbons containing one or more rings. The procedure is described in detail in Applicant's aforementioned co-pending patent application U.S. Ser. No. 720,840. HPLC techniques, in general, are described in a book authored by L. R. Snyder and entitled "Introduction to modern Liquid Chromatography."

Thin Layer Chromatography

The incompatibility of the asphaltene in the low molecular weight oil also may be determined in accordance with the procedures described in Applicant's aforementioned co-pending applications U.S. Ser. Nos. 723,598, 830,386, 910,910, and 024,730.

The TLC method involves placing a drop of a sample of the hydrocarbon liquid, such as crude oil, on a TLC film or membrane and permitting the sample tomigrate radially outwardly. As described in the said co-pending Applications, the incompatibility of the asphaltenes in the oil causes the drop to form rings which, when analyzed optically, provides an indication of the fouling tendency of the crude oil. The instrument described in co-pending application U.S. Ser. No. 910,910, filed Sept. 24, 1986, may be used to optically determine the fouling tendency of the crude.

Other Analytical Techniques

Any procedure for determining incompatibility of the asphaltenes may be employed. For example, NMR may be used to determine the aromatics of the crude oil and conventional quantitative analysis may be used to determine the asphaltenes. The ratio of aromatics/asphaltenes indicates the compatibility or incompatibility of the asphaltene in the crude oil.

Other Applications

The description of the preferred embodiments have emphasized the use of the present invention in connection with blending of crude oils and blending of alkanes or paraffinic oils with crude oils. Other applications where asphaltene compatibility is desired will occur to those skilled in the art. These include blending of bottoms with a feed stream and naphtha stops, mixed gas oils and other by-products produced from refining or chemical operations.

What is claimed is:

1. A method of blending two hydrocarbon liquids to form a hydrocarbon liquid blend of reduced fouling tendency, said method comprising:

(a) selecting a first hydrocarbon liquid which contains asphaltenes incompatible with the oil fraction thereof;

(b) selecting a second hydrocarbon liquid which contains substantially no asphaltenes or the asphaltenes thereof are more compatible in the oil fraction thereof than the asphaltenes in the first hydrocarbon liquid oil fraction;

(c) blending the two hydrocarbon liquids to form a stream;

(d) determining the level incompatible asphaltenes in the blend stream; and (e) adjusting the relativde proportions of each hydrocarbon liquid added in step (c) in response to step (d) to maintain the level of incompatible asphaltenes in the blend substantially below the level of incompatible asphaltenes in the first hydrocarbon liquid.

2. The method as defined in claim 1 wherein step (d) comprises determining the incompatible asphaltenes in various blend proportions of samples of the first and second hydrocarbon liquids; and step (e) comprises adjusting the relative proportions of the hydrocarbon liquids at one of the blend proportions which indicates a substantially lower level of incompatible asphaltene of the blend relative to the first hydrocarbon liquid.

3. The method as defined in claim 1 wherein the determining step (d) indicates the aromatic/asphaltene ratio of the blend.

4. The method of claim 3 wherein the determining step (d) is by chromatographic methods which separate incompatible asphaltenes from a sample of the blend.

5. The method as defined in claim 4 wherein the chromatographic method comprises depositing a drop of the blend on a thin layer chromatographic film or membrane and permitting the drop to migrate radially outwardly, the incompatible asphaltenes separating from the oil fraction in the form of interior dark rings within a matrix region of the oil fraction and compatible components.

6. The method as defined in claim 5 and further comprising measuring an optical property of the ring on the thin layer chromotographic film or membrane, the intensity and area relative to the matrix region providing an indication of the level of incompatible asphaltenes in the blend.

7. The method as defined in claim 1 wherein steps (a) and (b) for selecting the first and second hydrocarbon liquids comprises determining a property of each liquid which indicates the ratio of the aromatic to asphaltenes oil of each liquid, and steps (d) and (e) comprise monitoring a property of the blend indicative of the aromatic/asphaltenes oil ratio of the blend and controlling the relative proportions of each hydrocarbon liquid in the blend to maintain the aromatic/asphaltenes oil ratio thereof above a predetermined level.

8. The method as defined in claim 1 wherein step (d) comprises monitoring the blend for aromatic/asphaltene oil ratio and step (e) comprises adjusting the proportions of each liquid to maintain an aromatic oil/asphaltene ratio above a predetermined level.

9. A method of blending two hydrocarbon liquids to form a hydrocarbon blend of reduced fouling tendency, said method comprising;

(a) selecting a first hydrocarbon liquid which contains asphaltenes incompatible with the oil fraction thereof and determining the fouling tendency of the first hydrocarbon liquid;

(b) selecting a second hydrocarbon liquid which contains substantially no asphaltenes or the asphaltenes thereof are more compatible in the oil fraction thereof than the asphaltenes in the first hydrocarbon liquid oil fraction;

(c) blending the two hydrocarbon liquids;

(d) determining a property of the blend which is indicative of the level of incompatible asphaltenes in the blend; and (e) adjusting the relativde proportions of each hydrocarbon liquid and in response to step (d) to maintain the level of incompatible asphaltenes in the blend below a predetermined level which indicates a fouling tendency substantially lower than that of said first hydrocarbon liquid.

10. A method of blending a first crude oil containing low molecular weight oil fractions and asphaltenes incompatible therein and a second crude containing low molecular weight oil fractions and substantially no asphaltenes or asphaltenes more compatible therein than the asphaltenes in the first crude oil, said method comprising the steps of:

(a) continuously blending the crude oils to form a stream;

(b) monitoring the blend stream by determining the incompatible asphaltenes therein; and (c) controlling the blend ratio of the first and second crude oils in response to the monitoring step to maintain the incompatible asphaltenes of the blend stream below a predetermined level, said level being substantially lower than the incompatible asphaltenes in the first crude oil.

11. A method of blending a first crude oil which contains incompatible asphaltenes with a second crude oil which contains less incompatible asphaltenes than the first crude oil, said method comprising:

(a) blending the first crude oil with the second crude oil to form a blend;

(b) monitoring the incompatible asphaltenes in the blend; and (c) adjusting the blend ratio in response to the monitoring step to maintain the aromatic/asphaltene ratio of the blend above that of at least the first crude oil.

12. The method of claim 11 wherein the blending is such to maintain an aromatic to asphaltene ratio of the blend above 15 by weight.

13. The method of claim 12 wherein the blending is such to maintain the aromatic to asphaltene ratio above 19 by weight.

14. A method of blending a low to medium fouling hydrocarbon liquid containing asphaltenes with a substantially paraffinic liquid which comprises:

(a) blending the hydrocarbon liquid and the paraffinic liquid;

(b) monitoring the incompatible asphaltenes in the blend; and (c) controlling the blend ratio to prevent the incompatible asphaltenes in the blend from increasing above a predetermined level which indicates a fouling tendency substantially higher than that of the hydrocarbon liquid.

15. The method of claim 14 wherein the paraffinic liquid is volatile at atmospheric conditions and wherein the monitoring step (b) comprises determining incompatible asphaltenes in a blend of $C_5$ to $C_8$ paraffinic liquid and said hydrocarbon liquid to determine the volumetric ratio of the hydrocarbon liquid and $C_5$ and $C_8$ paraffin liquid at which fouling tendency increases substantially above that of the hydrocarbon liquid, and wherein step (c) comprises maintaining the blend ratio of the liquid hydrocarbon/paraffinic liquid above the ratio determined in step (b).

16. The method of claims 15 wherein the hydrocarbon liquid is crude oil and the $C_5$ to $C_8$ paraffin liquid is pentane.

17. A method of blending two hydrocarbon liquids to form a hydrocarbon liquid blend of reduced fouling tendency, said method comprising:

(a) selecting a first hydrocarbon liquid which contains asphaltenes incompatible with the oil fraction thereof;

(b) selecting a second hydrocarbon liquid which contains substantially no asphaltenes or the asphaltenes thereof are more compatible in the oil fraction thereof than the asphaltenes in the first hydrocarbon liquid oil fraction;

(c) determining the level of incompatible asphaltenes at various volume ratios of the first and second liquids; and (d) blending the first and second hydrocarbon liquids in response to step (c) to maintain the level of incompatible asphaltenes in the blend substantially below the level of incompatible asphaltenes in the first hydrocarbon liquid.

* * * * *